US005214233A

United States Patent [19]

Weldle et al.

[11] Patent Number: 5,214,233

[45] Date of Patent: May 25, 1993

[54] COCKING AND LOADING DEVICE FOR SELF-LOADING SMALL FIREARMS

[75] Inventors: Helmut Weldle, Oberndorf; Hubert Krieger, Schramberg-Waldmössingen, both of Fed. Rep. of Germany

[73] Assignee: Heckler & Koch GmbH, Oberndorf, Fed. Rep. of Germany

[21] Appl. No.: 835,950

[22] PCT Filed: Jul. 24, 1990

[86] PCT No.: PCT/DE90/00564

§ 371 Date: Apr. 21, 1992

§ 102(e) Date: Apr. 21, 1992

[30] Foreign Application Priority Data

Aug. 25, 1989 [DE] Fed. Rep. of Germany ..... 39281256

[51] Int. Cl.[5] ..... F41A 19/52

[52] U.S. Cl. ..... 89/1.400

[58] Field of Search ..... 89/1.4

[56] References Cited

U.S. PATENT DOCUMENTS

| | | | |
|---|---|---|---|
| 3,651,736 | 3/1972 | Ingram | 89/1.4 |
| 4,467,698 | 8/1984 | Perrine | 42/25 |
| 4,821,621 | 4/1989 | Lorenzo | 89/143 |

FOREIGN PATENT DOCUMENTS

| | | |
|---|---|---|
| 648060 | 5/1964 | Belgium . |
| 2023523 | 9/1975 | Fed. Rep. of Germany . |
| 55392 | 1/1911 | Switzerland . |
| 413071 | 7/1934 | United Kingdom . |

OTHER PUBLICATIONS

The book of Herkimer (FIG. 5 on p. 128).

The Russian book of Artobolski (Examples 129, 349 and 396).

*Primary Examiner*—Stephen C. Bentley

*Attorney, Agent, or Firm*—Fields, Lewis, Pittenger & Rost

[57] ABSTRACT

In a cocking and loading device (3) for self-loading small firearms which are provided with a bolt movable in their longitudinal direction, in particular for an automatic rifle, with a pivoted cocking lever (4) which extends in its rest position in the longitudinal direction of the weapon and can be transferred into an operating position by lateral pivoting, in said operating position a spring (6) endeavoring to pivot the cocking lever forward and to retain it in the rest position exterts pressure on said cocking lever, a simple construction of the cocking and loading device by means of which the bolt can be displcaed in the cocking direction as well as in the opposite direction and greater safety for the rifleman against injuries during shooting are achieved by the fact that the cocking lever (4) is accomodated in its rest position within the exterior conture of the weapon and is arranged at the bolt directly or by means of an intermediate part. Due to the fact that the cocking and loading device (3) is fixed at the bolt an extensive construction with additional parts of the weapon is avoided, reducing the weight and the propensity to malfunctions of the weapon.

14 Claims, 2 Drawing Sheets

COCKING AND LOADING DEVICE FOR SELF-LOADING SMALL FIREARMS

The invention relates to a cocking and loading device for self-loading small firearms which are provided with a bolt movable in their longitudinal direction, in particular for an automatic rifle, with a pivoted cocking lever which extends in its rest position in longitudinal direction and can be transferred into an operating position by lateral pivoting, in said operating position a spring endeavouring to pivot the cocking lever forward and to retain it in the rest position exerts pressure on said cocking lever.

The German Patent 20 23 523 teaches a cocking and loading device by which the bolt of a weapon can be moved from its front position into a rear position, in the case of weapons which close on firing, in order to convey the bolt into the rear position so that it is caught by the triggering mechanism or that the bolt, when moving forwardly, introduces a cartridge into the barrel when the weapon is to be made ready to fire. In addition, it may be necessary to retract the bolt for clearing jammings. In order to ensure the back-movement of the bolt, the cocking and loading device is provided with a cocking lever which is transferred from its rest position into an operating position by pivoting, in this operating position the cocking lever passes through a slot which extends in the longitudinal direction of the weapon and projects the weapon laterally. This cocking lever which projects laterally serves the rifleman as a handle in order to retract the bolt. In order to avoid that this cocking lever is also actuated together with the bolt which runs back and forth during shooting and thus represents a considerable source of danger to the rifle man it is suggested not to mount the cocking lever directly at the bolt, but to attach it to a sliding element, so that the cocking movement can be transferred to the bolt via this sliding element which is movably arranged correspondingly to the bolt in the housing of the weapon and the cocking lever is disconnected from the cocking lever by means of the sliding element and thus from the movements of the bolt. Such solutions have the disadvantage that many parts are necessary which increase the weight, the time needed for maintenance, as well as the propensity for malfunctions of the weapon.

Because of the fact that the slide element associated with the cocking lever is not connected to the bolt of the weapon, but only abuts on the front side of the bolt, only the cocking movement for transferring the bolt into its rear position can be performed by means of this cocking and loading device, yet, e.g. in case of jamming or the like, when the bolt is trapped in a position between its front and rear position, these cocking and loading devices are not suitable for transferring the bolt into the front position, i.e. to serve as a closing means, because the slide element is not coupled with the bolt. Such a coupling can only be achieved by additional extensive means (DE-B-19 02 275).

Another disadvantage is that also in the case of a cocking lever abutting on the housing this lever usually projects over the surface of the housing (German Patent 20 23 523), which may be cumbersome in the use of the weapon, in particular when it is used in difficult terrain with thick undergrowth or when the weapon is held improperly when firing it.

Therefore it is the object of the present invention to avoid these disadvantages of the known cocking and loading devices and to provide a safe cocking and loading device by which the bolt can easily be moved into the rear as well as into the forward position.

The present invention solves this object by that fact that the cocking lever is accommodated in its rest position within the exterior contour of the weapon and arranged at the bolt directly or by means of an intermediate part.

The cocking and loading device according to the present invention comprises a cocking lever which is coupled to the bolt in that the cocking lever is either pivoted at the bolt directly or connected to the bolt by means of an intermediate part in a force-locking manner. Now, this cocking lever allows to move the bolt into the rear position as well as into the front position, because it permanently engages the bolt. As a result, the cocking lever also carries out the movements of the bolt which run forwardly and rearwardly when firing and thus is arranged within or at the exterior contour of the weapon in its rest position in which it is aligned in the longitudinal direction of the weapon, i.e. pivoted back from its operating position. Now, the rifleman is no longer in the danger to be injured by the cocking lever running forwardly and rearwardly. Due to the fact that the cocking lever is connected with the bolt directly or by means of an intermediate part, such cocking and loading devices or weapons with these cocking and loading devices have a lower weight and are easier to be maintained and less prone to malfunctions, because they have less construction parts. A preferred embodiment provides that the cocking lever does not absolutely have to run through the housing of the weapon via a slot extending in longitudinal direction.

According to a preferred embodiment in a bolt consisting of two parts, i.e. a bolt head carrier and a bolt head arranged in the bolt head carrier, the cocking lever is fixed at the bolt head carrier.

Advantageously the forward end of the bolt head carrier, i.e. the one facing the muzzle of the weapon, is slotted and the cocking lever is arranged between the two thighs which form the slot.

A preferred embodiment provides that the cocking lever can be pivoted around a pin arranged transversely to the slot. With a slot lying transversely in the operating position of the weapon the pin is in vertical position, passing through the two thighs of the end of the bolt having the slot and being fixed in it. This pin preferably represents the pivot point for the cocking lever.

The resetting of the cocking lever from the operating position into the rest position is preferably realized by the fact that the spring urging the cocking lever into the rest position engages the cocking lever by means of a slide. In this case the slide is constructed so that when pivoting the cocking lever from the rest position into the operating position it is guided slidably in the bolt in the longitudinal direction of the weapon against the spring tension.

A preferred embodiment of the invention provides that seen from the longitudinal direction of the weapon the cocking lever is arranged at the one side of the pin and the slide is arranged at its other side. The spring acts on the slide in such a way that it is urged into the direction of the pin within the bolt. According to an embodiment of the invention a power transfer from the slide to the cocking lever is preferably realized by the fact that the slide embraces the pin and abuts on a contact surface of the cocking lever. The power of the spring urging the slide in direction of the pin is thus transferred around the pin to the cocking lever positioned at the other side of the pin and thus said cocking lever is urged into its rest position. If the cocking lever is pivoted from its rest position in direction of the operating position, by means of the contact surface this change of position is transferred to the slide which abuts on this surface and is also displaced against the spring tension. The displacing action of the slide is stored in the spring and released after disengaging the cocking lever by pivoting it into the rest position.

Advantageously the contact surface is at a distance from the pin axis and the thighs of the slide which embrace the pin are also at a lateral distance from the pin axis. By means of these distances lever arms are formed which, when the cocking lever is pivoted, serve as lever gear and transfer the pivot movement of the cocking lever in a movement displacing the slide and vice versa.

According to an embodiment of the invention, with the cocking lever being in operating position the contact point of the slide at the contact surface of the cocking lever is displaced laterally relative to the longitudinal axis of the weapon. This has the advantage that during the pivot movement of the cocking lever from the rest position into the operating position the lever arms change, influencing the lever moment in such a way that it increases or decreases with increasing pivoting. A decreasing lever moment entrains that the cocking lever can be retained in the rest position by a rifleman without that great power is necessary and moreover the cocking lever is securely fixed in the rest position within the housing of the weapon by means of the spring.

A continual change of the lever arm with the pivoting of the cocking lever from the rest position into the operating position is achieved by the fact that the contact surface has a convex bend relative to the pin.

Advantageously the cocking lever can be pivoted out of the housing of the weapon to the two sides of the longitudinal axis of the weapon. Weapons having such a cocking and loading device can be operated equally well by left-handed as well as right-handed persons.

Preferably the cocking lever can be transferred to the operating position laterally, vertically, as well as from an intermediate position. Thus the cocking and loading abilities are further improved. A preferred embodiment provides that the bolt head carrier projects at least partially the housing of the weapon with its upper side.

Advantageously, above the bolt head carrier, the housing of the weapon is provided with a carrying handle which in particular overlaps the bolt head carrier. A further development provides that the cocking lever is arranged in a carrying aperture of the weapon. The carrying handle permits a very easy and comfortable service of the weapon and provides great free space around the cocking lever which can now be pivoted in all directions and the bolt can be retracted in the pivoted position of the lever. This free space of the cocking lever is at the same time used as gripping or carrying aperture.

A decrease in wear of the cocking lever and of the slide is achieved by the fact that the parts of the slide and of the cocking lever which abut on one another have tempered surfaces.

Further details, advantages and features of the invention will become apparent from the following description showing a preferred embodiment with reference to the drawing.

Figure 1:
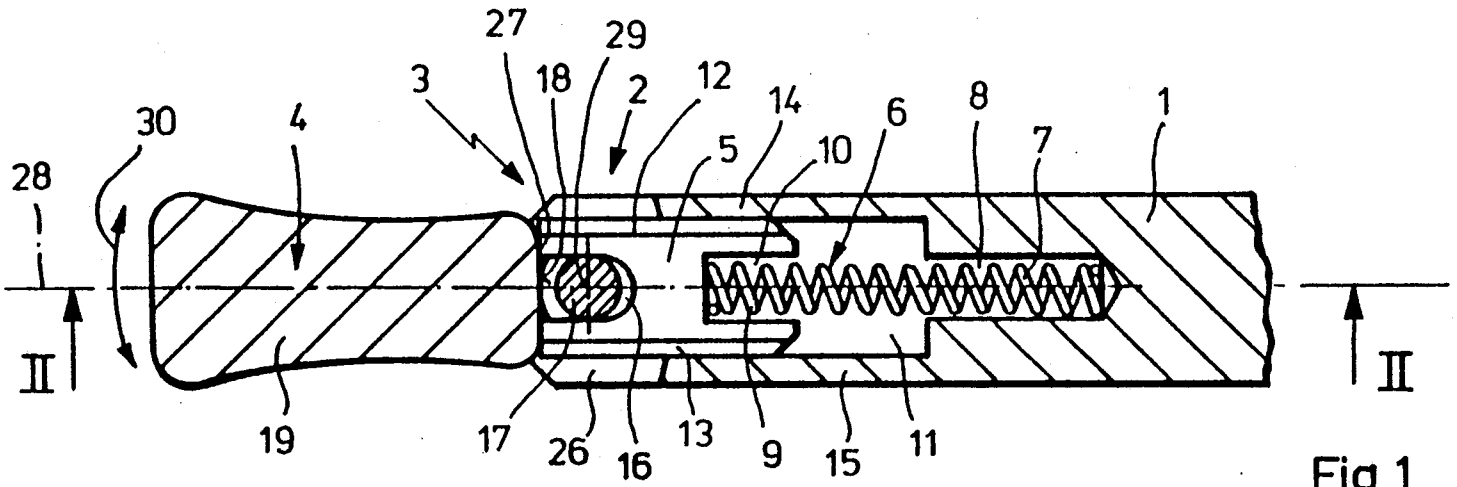
FIG. 1 shows a top view of a longitudinal section through a cocking and loading device inserted in the forward end of a bolt, the cocking and loading device being in the rest position.

The embodiment of the invention shown in FIG. 1 shows a broken-off representation of the bolt head carrier 1 of a two-part bolt having a bolt head arranged in a bolt head carrier 1, a cocking and loading device comprised by the reference numeral 3 is arranged at the forward end 2 of said bolt head carrier 1 which faces the muzzle of a weapon not shown. This cocking and loading device 3 consists of a cocking lever 4, a slide 5 and a coil-pressure spring 6 which in sliding direction of the bolt head carrier 1 rests with its one end 7 in a blind hole 8 arranged in the bolt head carrier 1. The other end 9 of the coil spring 6 engages in a recess 10 of the H-shaped slide 5. This H-shaped slide 5 is guided in a groove 11 in longitudinal direction of the bolt head carrier 1, the thighs 12 and 13 being surrounded by the walls 14 and 15 of the groove 11 in a sliding manner. The slide 5 is urged into its rest position by means of the coil spring 6, the thighs 12 and 13 abutting on the contact surface 18 of the cocking lever 4. Moreover, the ends of the thighs 12 and 13 facing the blind hole 8 surround the end 9 of the coil spring 6 and hold it safely in the recess 10. The two other ends of the thighs 12 nd 13 facing the cocking lever 4 surround a pin 17 arranged in a recess 16 and abut with their front sides on the cocking lever 4 at a contact surface 18.

Figure 2:
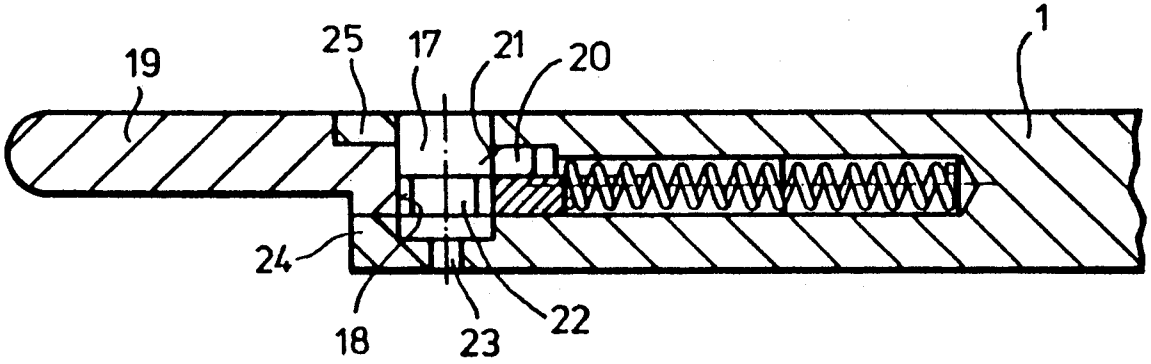
FIG. 2 shows a section II—II of the cocking and loading device arranged in the forward end of the bolt according to FIG. 1.

The cut-section II—II illustrated in FIG. 2 shows that the cocking lever 4 consists of a handle 19 and a mounting member 20, the mounting member 20 engaging in the bolt head carrier 1 and having a hole 21 through which the pin 17 passes. The hole 21 serves as a pivoting point for the cocking lever 4 which according to the arrow 30 can be pivoted by about 90° around the pin 17 in both directions. As also shown in FIG. 2 the pin 17 has a projecting section 22 the diameter of which corresponds to the width of the recess 16 between the forward ends of the two thighs 12 and 13 and the height of which corresponds to the height of the slide 5. At the lower end the pin 17 ends in a journal 23 the diameter of which is also smaller than the one of the pin 17. This formation of the pin 17 ensures a safe seat in the lower thigh 24 of the bolt head carrier 1. The pin 17 is prevented from dropping by riveting.

Figure 3:
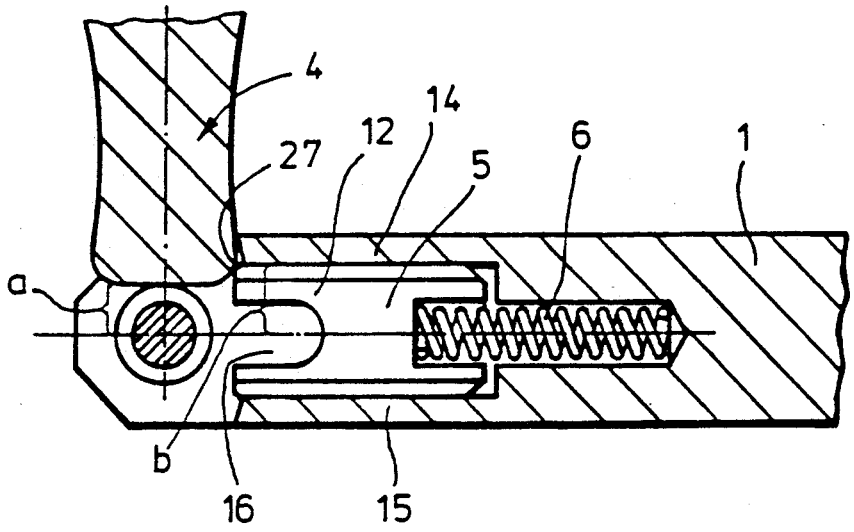
FIG. 3 shows a view according to FIG. 1, the cocking and loading device being in its operating position.

As shown in FIGS. 1 and 3 the walls 14 and 15 of the groove 11 do not extend to the forward end of the bolt head carrier facing the muzzle of the weapon, so that in the section around the pin 17 a slot 26 traversing the bolt head carrier 1 is formed, the slide 5 engages this slot 26 when the cocking and loading device 3 is in the rest position, as shown in FIG. 1. If the cocking lever 4 is transferred from the rest position into the operating position by pivoting the handle 19, as shown in FIG. 3, the slide 5 is displaced in its rear position by pivoting the handle 19 via the contact surface 18, because the slide 5 is removed from the area of the slot 26. Advantageously the contact point 27 of the thigh 12 or 13 at the handle 19 moves along the contact surface 18 and moves away from the center longitudinal axis 28 of the cocking and loading device 3. Due to the distance of the contact surface 18 from the pin axis 29 and by means of the distance of the two thighs 12 and 13 from the pin axis 29 the two lever arms a and b, which come into use when the cocking lever 4 is pivoted, can be defined. Moreover, by means of the convex bend of the contact surface 18 in particular in its outer areas the lever arms a and b of the lever gear unit are advantageously influenced by the handle 19 and the slide 5. A riflemen can easily prevent that the handle swings back into its rest position in that the rifleman himself exerts a torque at the cocking lever 4 so that it remains in the operating position and nevertheless power in the firing direction of the weapon, i.e. in opposite direction of the cocking and loading device, can be exerted on the bolt head carrier 1. If the cocking lever 4 is disengaged from its operating position, as shown in FIG. 3, the slide 5 by means of its thigh 12 exerts power on the contact surface 18 of the cocking lever 4 due to the compressed coil spring 6, said power entrains a pivoting of the cocking lever 4 into the rest position shown in FIG. 1. The cocking lever 4 is within the exterior contour of the weapon in this rest position.

As also shown in FIG. 3 the two walls 14 and 15 are shortened, so that the cocking lever 4 can also be pivoted into the other operating position, which is not shown in FIG. 3. From this position, too, the cocking lever is automatically pivoted back into the rest position by means of the slide 5 after disengagement.

We claim:

1. Cocking and loading device for a weapon including self-loading small firearms which are provided with a muzzle and a bolt movable in a longitudinal direction of the weapon, comprising:

a pivoted cocking lever which extends in a rest position in the longitudinal direction of the weapon and can be transferred into an operating position by lateral pivoting, said cocking lever being pivotally mounted with an end facing away from the muzzle in the rest position of the cocking lever at the forward end of said bolt, in said operating position a spring endeavoring to pivot the cocking lever forward and to retain said cocking lever in the rest position exerts pressure on said cocking lever, the cocking lever being accommodated in its rest position within the exterior contour of the weapon, characterized in that said cocking lever is arranged at the bolt and can be pivoted out of a housing of the weapon to the two sides of the longitudinal axis of the weapon.

2. Cocking and loading device according to claim 1, characterized in that the cocking lever is fixed against movement along the longitudinal axis of a bolt head carrier.

3. Cocking and loading device according to claim 1, characterized in that the spring which urges the cocking lever into the rest position engages the cocking lever by means of a slide.

4. Cocking and loading device according to claim 3, characterized in that the slide is guided slidably in the bolt in the longitudinal direction of the weapon against the spring tension when pivoting the cocking lever from the rest position into the operating position.

5. Cocking and loading device according to claim 3, characterized in that seen from the longitudinal direction of the weapon the cocking lever is arranged at the one side of the pin and the slide on its other side.

6. Cocking and loading device according to claim 3, characterized in that the slide embraces the pin and abuts on a contact surface of the cocking lever.

7. Cocking and loading device according to claim 6, characterized in that the contact surface is at a distance from the pin axis.

8. Cocking and loading device according to claim 6, characterized in that the thighs of the slide which embrace the pin are at a lateral distance from the pin axis.

9. Cocking and loading device according to claim 6, characterized in that the contact surface has a convex bend relative to the pin.

10. Cocking and loading device according to claim 3, characterized in that with the cocking lever being in operating position the contact point of the slide at the contact surface of the cocking lever is displaced laterally relative to the longitudinal axis of the weapon.

11. Cocking and loading device according to claim 3, characterized in that the parts of the slide and of the cocking lever which abut on one another have tempered surfaces.

12. Cocking and loading device according to claim 1 characterized in that said cocking lever includes a handle and a mounting member, said mounting member facing away from the muzzle of the weapon in the rest position, the cocking lever being pivotally mounted at the bolt by means of said mounting member.

13. Cocking and loading device for a weapon including self-loading small firearms which are provided with a muzzle and a bolt movable in a longitudinal direction of the weapon, comprising:

a pivoted cocking lever which extends in a rest position in the longitudinal direction of the weapon and can be transferred into an operating position by lateral pivoting, in said operating position a spring endeavoring to pivot the cocking lever forward and to retain said cocking lever in the rest position exerts pressure on said cocking lever, the cocking lever being accommodated in its rest position within the exterior contour of the weapon, characterized in that said cocking lever is arranged at the bolt and can be pivoted out of a housing of the weapon to the two sides of the longitudinal axis of the weapon, a forward end of the bolt facing the muzzle of the weapon has a slot that defines two thighs and the cocking lever has a mounting portion that is arranged to pivot between the two thighs.

14. Cocking and loading device according to claim 13, characterized in that the cocking lever an be pivoted around a pin arranged transversely to said slot.

* * * * *